US006082013A

United States Patent [19]

Peterhans

[11] Patent Number: 6,082,013

[45] Date of Patent: Jul. 4, 2000

[54] APPARATUS FOR LEVELING AN OBJECT

[76] Inventor: Dieter Peterhans, Alte Birmensdorferstrasse 11, 5442 Fislisbach, Switzerland

[21] Appl. No.: 09/056,376

[22] Filed: Apr. 7, 1998

[30] Foreign Application Priority Data

Apr. 11, 1997 [CH] Switzerland ..... 0852/97

[51] Int. Cl.[7] ..... G01C 15/00

[52] U.S. Cl. ..... 33/285; 33/293; 33/DIG. 21

[58] Field of Search ..... 33/227, 228, 285, 33/286, 293, 295, 529, 533, 574, 613, 645, 666, DIG. 21; 52/747.1, 365

[56] References Cited

U.S. PATENT DOCUMENTS

| | | | |
|---|---|---|---|
| 2,699,140 | 1/1955 | Fisher | 33/293 |
| 3,775,929 | 12/1973 | Roodvoets et al. | 52/747 |
| 3,857,639 | 12/1974 | Mason | 33/293 |
| 3,909,952 | 10/1975 | Lagasse | 33/574 |
| 5,367,782 | 11/1994 | Izumitani | 33/367 |
| 5,484,026 | 1/1996 | Susaki et al. | 173/4 |
| 5,493,786 | 2/1996 | Thomson | 33/DIG. 21 |
| 5,829,147 | 11/1998 | Kousek et al. | 33/293 |
| 5,864,956 | 2/1999 | Dong | 33/DIG. 21 |

FOREIGN PATENT DOCUMENTS

| | | |
|---|---|---|
| 0559489 | 9/1993 | European Pat. Off. . |
| 4072509 | 3/1992 | Japan . |

*Primary Examiner*—G. Bradley Bennett
*Attorney, Agent, or Firm*—Jacox, Meckstroth & Jenkins

[57] ABSTRACT

For leveling an object, in particular a suspended ceiling, which is to be attached to mounting members, such as suspension wires, the latter are cut off or provided with a suited mark. A device with a detector for detecting a reference level is used for this purpose. The device is pushed over the mounting member. As soon as the detector determines that the device is at the appropriate position, the mounting member is cut off by means of a cutter or worked in another suitable way for generating a reference mark thereon.

14 Claims, 5 Drawing Sheets

APPARATUS FOR LEVELING AN OBJECT

CROSS REFERENCE TO RELATED APPLICATIONS

This application claims the priority of Swiss application 0852/97, filed on Apr. 11, 1997, the disclosure of which is incorporated herein by reference in its entirety.

BACKGROUND OF THE INVENTION

The invention relates to a device for leveling an object, in particular a suspended ceiling, wherein the object is held by rod-like mounting members, wherein the device comprises a detector for detecting a reference level and guiding means for guiding the mounting member. The invention also relates to a method for suspending a ceiling to rod-like mounting members and to a suspension member for being mounted to a rod-like mounting member.

It is known to level objects by means of a laser. For this purpose, a laser beam is deflected by a rotating mirror for defining a reference level, which is then used as a reference system for leveling the object.

This method allows e. g. to adjust the suspension for a suspended ceiling. The suspension comprises a plurality of rod-like mounting members with suspension members affixed thereto. The ceiling is suspended from the suspension members. For leveling the ceiling, the suspension members are attached to the mounting members at a predefined distance from the reference level defined by the laser. Similar methods can be used for leveling walls or floors.

Laser leveling is also used for mounting heavy machinery. Here, screws are positioned in a foundation, the threadings of which stick out of the concrete. Nuts must be screwed to all threadings for receiving the machinery. The nuts are positioned at a fixed distance from the laser. U.S. Pat. No. 5,484,026 describes a device for automatically positioning the nuts. Positioning nuts in this way is, however, time consuming and complicated

BRIEF SUMMARY OF THE INVENTION

Hence, it is a general object of the invent-on to provide a method and device that provides an efficient and quick way to level ceilings or other objects.

It is a further object of the invention to provide suspension members that can be used efficiently with such a method and device.

Now, in order to implement these and still further objects of the invention, which will become more readily apparent as the description proceeds, the device for leveling an object, in particular a suspended ceiling, which object is mounted to a plurality of rod-like mounting members is manifested by comprising a reference level detector for detecting a reference level, a guiding means for longitudinally guiding one of said mounting members, and a reference generating means controlled by said reference level detector for automatically generating a reference point on said one mounting member by mechanically working said one mounting member.

By mechanically working the mounting member, the reference point can be generated quickly and easily.

Preferably, a holder means is provided for automatically holding the mounting member while it is worked to prevent a displacement thereof. For correcting the position of the reference point, adjustment means can be provided for adjusting the distance of the reference generating means to the holder means and the reference level.

In a further aspect of the invention the device is manifested by comprising a reference level detector for detecting a reference level, a guiding means for longitudinally guiding one of said mounting members, a reference generating means controlled by said reference level detector for automatically generating a reference point on said one mounting member, and an angle detector for detecting an angle between said one mounting member and said reference level. This allows to compensate for a tilted position of the mounting member in respect to the reference level. For providing an even more accurate correction, a detector can be provided for measuring a distance to a wall or ceiling, respectively.

In yet a further aspect of the invention, a method for suspending a ceiling to rod-like mounting members is provided comprising the steps of providing a reference level, cutting off said mounting members at a predefined distance from said reference level, attaching suspension members to the ends of said mounting members, and suspending said ceiling on said suspension members.

In another aspect of the invention a suspension member for being mounted to a rod-like mounting member and for receiving an object to be suspended to a plurality of said mounting members is provided comprising an affixing means for affixing said suspension member to said mounting member, a suspension means for receiving said object and a stop for abutting against an end of said suspension member for accurately positioning said suspension member on said mounting member.

The device and method are especially suited for leveling a suspended ceiling.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

In the following, the invention is explained by reference to a suspended ceiling. This is only one possible application of the invention Some further applications are listed at the end of the description.

Figure 1:
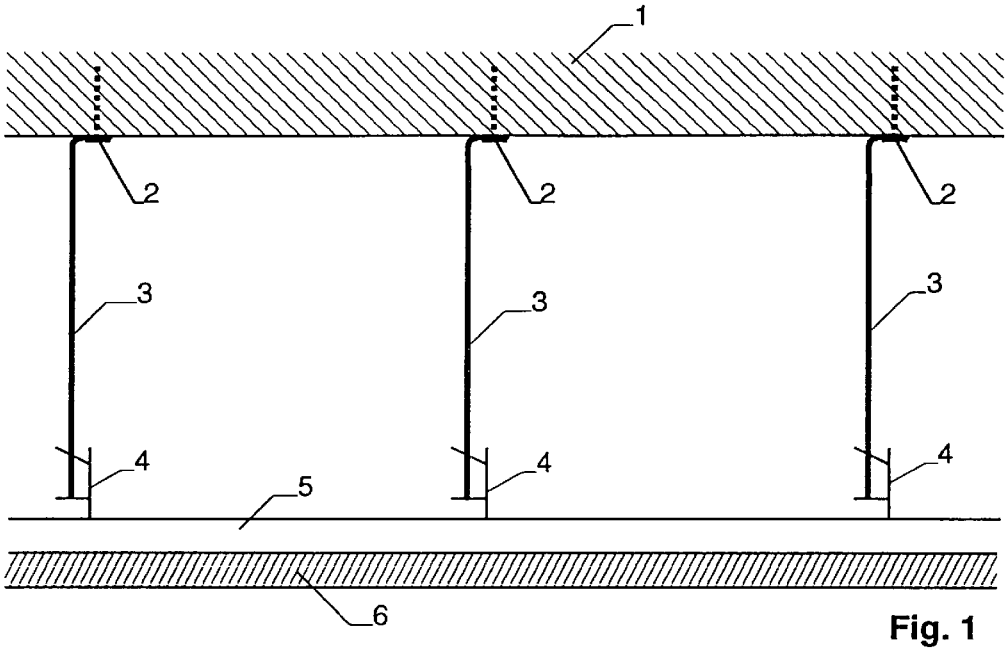
FIG. 1 is a sectional view of a suspended ceiling.

The basic design of a suspended ceiling is illustrated in FIG. 1 and comprises a concrete ceiling 1 with dowels 2 attached at regular intervals. Mounting members 3, such as suspension wires or rods, are suspended to the dowels 2. Suspension members 4 are attached to the bottom end of the mounting members 3. The suspension members 4 are hooked into profiles 5, which carry a suspended ceiling 6.

Figure 2:
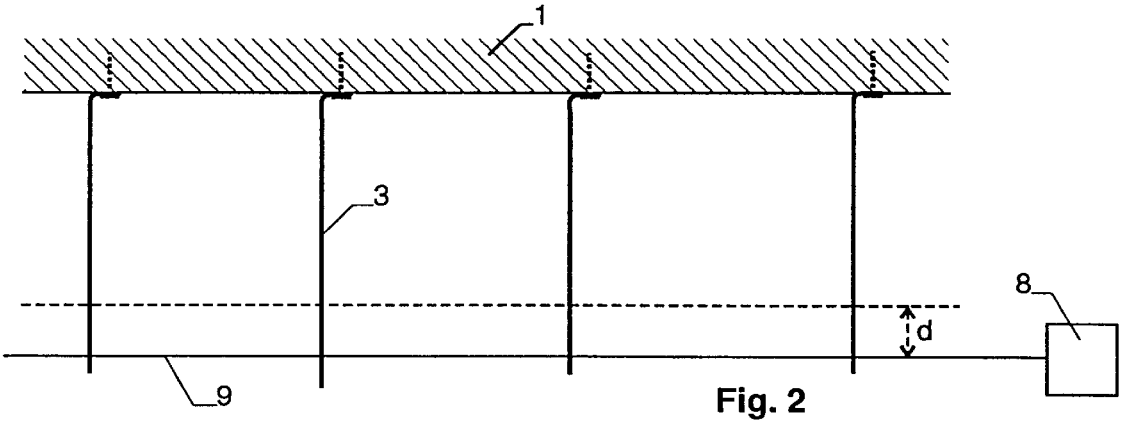
FIG. 2 is an illustration of the steps for cutting off the mounting members.

The mounting members 3 must all be cut off at the same height in order to level the suspended ceiling. This is carried out in the manner illustrated in FIG. 2.

First, the mounting members 3 are suspended. Then, a laser leveling device 8 is mounted in conventional manner. It generates a laser beam which is spread into a horizontal plane 9 by a rotating mirror mechanism. Horizontal plane 9 is designated as reference level.

The reference level is used for cutting off all mounting members 3 at the same height. For this purpose, the mounting members 3 are cut off at a given distance d from the reference level. This is carried out with a device described below.

Figure 3:
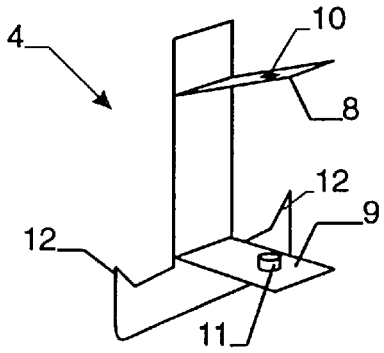
FIG. 3 is a suspension member for being mounted to the mounting members.

After cutting off the mounting members 3, the suspension members 4 are attached to the mounting members 3. As can be seen from FIG. 3, each suspension member 4 has two arms 8, 9. A hole 10 is arranged in upper arm 8, the inner diameter of which is slightly larger than the outer diameter of the mounting members 3. A cylindrical shoe 11 closed at its lower end is arranged on lower arm 9.

For mounting suspension member 4 to mounting member 3, upper arm 8 is pushed slightly down such that hole 10 is substantially perpendicular to the longitudinal axis of mounting member 3. Then, mounting member 3 is introduced into hole 10 and suspension member 4 is slid up until the lower end of mounting member 3 enters shoe 11 and abuts on lower arm 9. Now, arm 5 is released for jamming mounting member 3 in hole 10. Lower arm 9 forms a stop that defines the position of suspension member 4 at the end of mounting member 3.

Then, the profiles 5 can be suspended to the hooks 12 of the suspension members 4.

Figure 4:
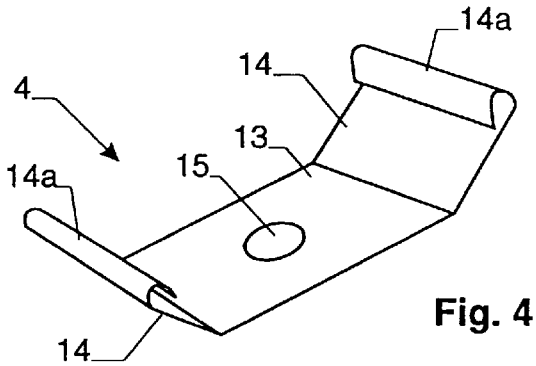
FIG. 4 is a second embodiment of a suspension member.
Figure 5:
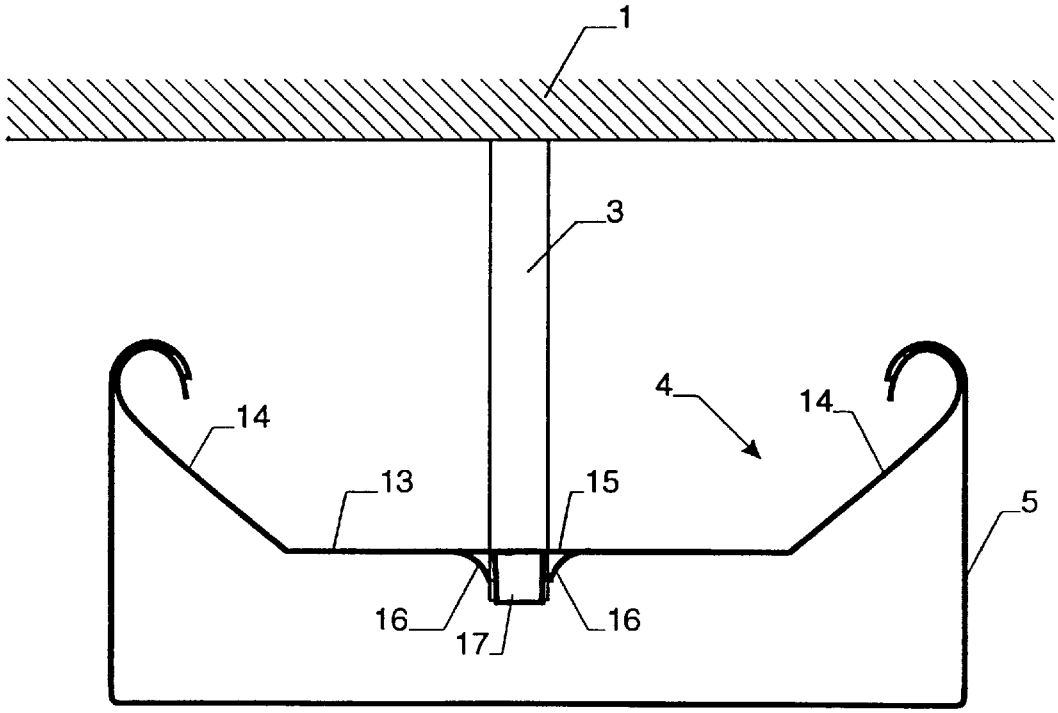
FIG. 5 is a sectional view of the suspension member of FIG. 4 snapped into a profile.

FIGS. 4 and 5 show an alternative embodiment of suspension member 4. It consists of a roughly U-shaped plate 13 with two lateral spring arms 14. An opening 15 is arranged at the base or center of plate 13 for receiving mounting member 3. A holder mechanism for affixing mounting member 3 is arranged below opening 15 and comprises two lateral springs 16 for holding mounting member 3 and a bracket 17 forming a stop for the end of mounting member 3.

As illustrated in FIG. 5, this embodiment of the suspension member is snapped into profile 5 by means of its spring arms 14.

The embodiment of FIGS. 4 and 5 allows mounting suspended ceiling 6 very close to concrete ceiling 1. This is made possible by the fact that the affixing mechanism of parts 15–17 can be located within profile 5 because the upper ends 14*a* of the spring arms 14 form the highest point of the suspension member.

Figure 6:
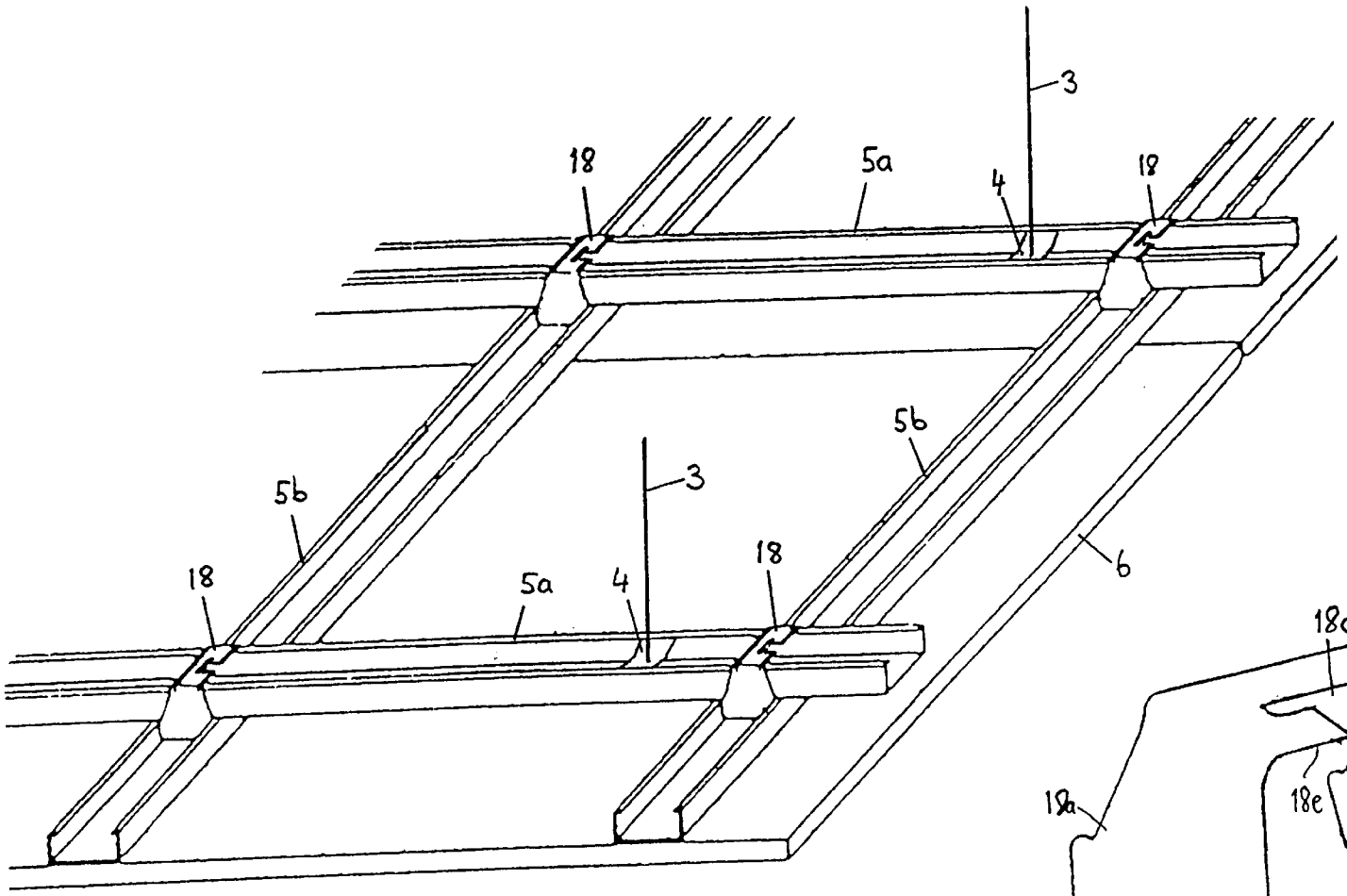
FIG. 6 is a ceiling construction with a double grate.

FIG. 6 shows a ceiling design with a double grate, i.e. transversal profiles 5*a* and longitudinal profiles 5*b* are provided for stabilizing the suspended ceiling. The mounting members 3 with the suspension members 4 are hooked into the transversal profiles 5*a*.

Figure 7:
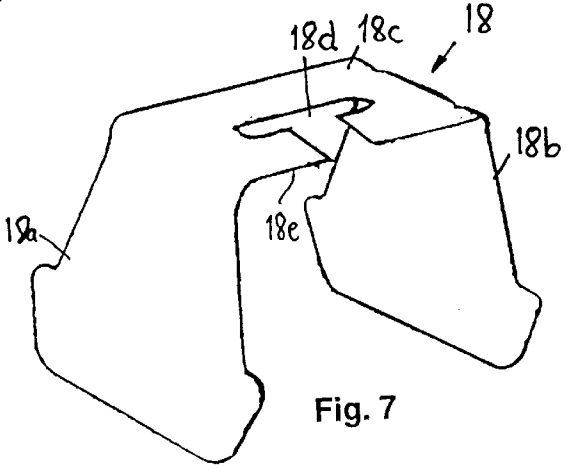
FIG. 7 is a cross connection for the ceiling construction of FIG. 6.

For connecting the transversal profiles 5*a* and the longitudinal profiles 5*b*, cross connectors 18 are arranged at the crossing points. FIG. 7 shows one such cross connector 18. It has the form of a bracket with two lateral arms 18*a*, 18*b* hooked into a longitudinal profile 5*b* and a central section 18*c* for reaching around one of the transversal profiles 5*a*. A slit 18*d* is arranged in central section 18*c* extending from a lateral edge 18*e* of the cross connector to at least its center. It serves for receiving a mounting member 3 in case that a cross connector 18 is to be arranged right over a suspension member 4. This makes it possible to mount all mounting members in exactly vertical position, which simplifies cutting the mounting members as described below.

Figure 8:
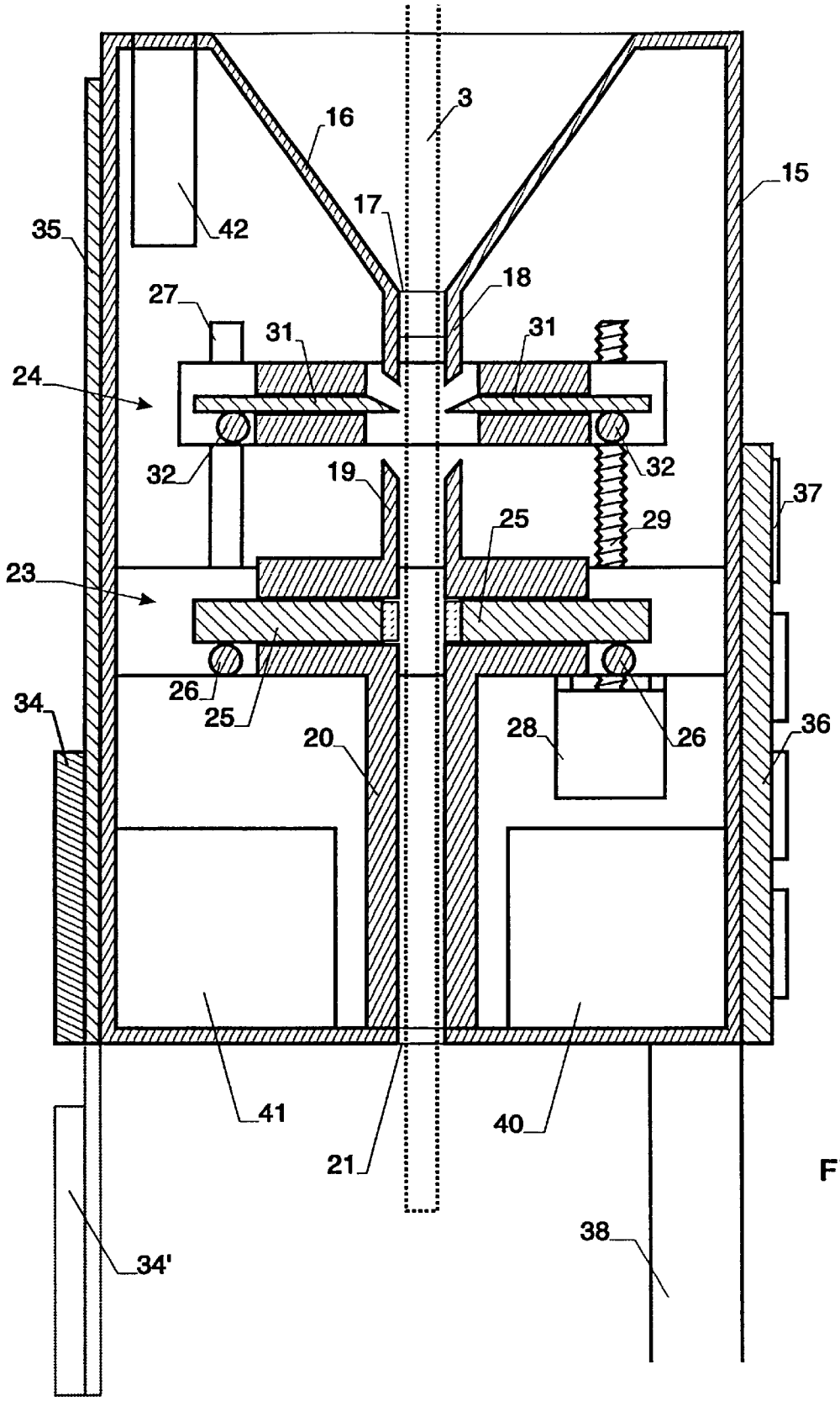
FIG. 8 is a sectional view of an embodiment of the device according to the present invention.

FIG. 8 shows a device for cutting off the mounting members. It comprises a housing 15 of preferably cylindrical or rectangular shape. A hopper or funnel 16 with a central upper opening 17 is arranged on the top side of housing 15. Upper opening 17 is aligned to a first tube section 18. Coaxially thereto, further tube sections 19 and 20 are provided within the device, which lead to a lower opening 21. The openings 17 and 21 and the tube sections 18–20 form a guide for introducing one of the mounting members 3.

A holder 23 and a cutter 24 are arranged within the device.

Holder 23 is rigidly connected to housing 15. It comprises two holder jaws 25, the ends of which facing mounting member 3 are padded with plastic or rubber. The holder jaws 25 can be radially extended against mounting member 3 by means of driven shafts 26.

Cutter 24 is mounted on rods 27 such that it can be displaced along the longitudinal direction of housing 15 by means of a drive 28 with spindle shaft 29.

Cutter 24 comprises two knives 31, the cutting edges of which are facing mounting member 3. They can be radially extended against mounting member 3 for cutting the same by means of two driven shafts 32.

A detector 34 is arranged outside hosing 15 for detecting the beam of laser leveling device 8. Preferably, a one dimensional CCD array or photo diode array is used for this purpose, which extends parallel to mounting member 3 such that the height of reference level 9 can be detected over a certain range. For extending this range, detector 34 can be mounted to a extendible rod 35 such that it can be affixed in at least two positions. Such an alternative position is indicated by reference numeral 34'.

A keyboard 36 and a display 37 are arranged on housing 15. Keyboard 26 is used for entering the desired distance d from the cut position to reference level 9 (cf. FIG. 2), either as explicit size or by entering other information that allows to derive this size, e.g. the type of the used suspension member and ceiling and the distance of the reference level to the ceiling.

Further, a holder rod 38 is attached to housing 15 for operating the device from the floor.

Control electronics 40, a inclination detector 41 and an ultrasound distance detector 42 are also arranged within the housing, the functions of which will be described below.

When using the device, it is led to one of the mounting members 3 from below. Because of the hopper or funnel shape 16, mounting member 3 is led to opening 17. When the device is lifted further, mounting member 3 reaches tube sections 18–20 and finally exits through lower opening 21. As soon as reference level 9 has reached the predefined area of detector 34, the electronics 40 actuate holder 23, holder jaws 25 are extended and lock mounting member 3. Then, depending on the actual position of reference level 9 on detector 34 and the angle of inclination of the device, cutter 24 is adjusted by means of drive 28 such that it is at the desired cutting position of holder member 3. Then, the knives 31 are operated for cutting mounting member 3. Finally, the knives 31 and the holder jaws 25 are retracted and release mounting member 3.

If mounting member 3 is exactly perpendicular to the reference level, i.e. if it is exactly vertical, the cutting position can be calculated directly from the position of reference level 9 and the desired distance d.

Figure 9:
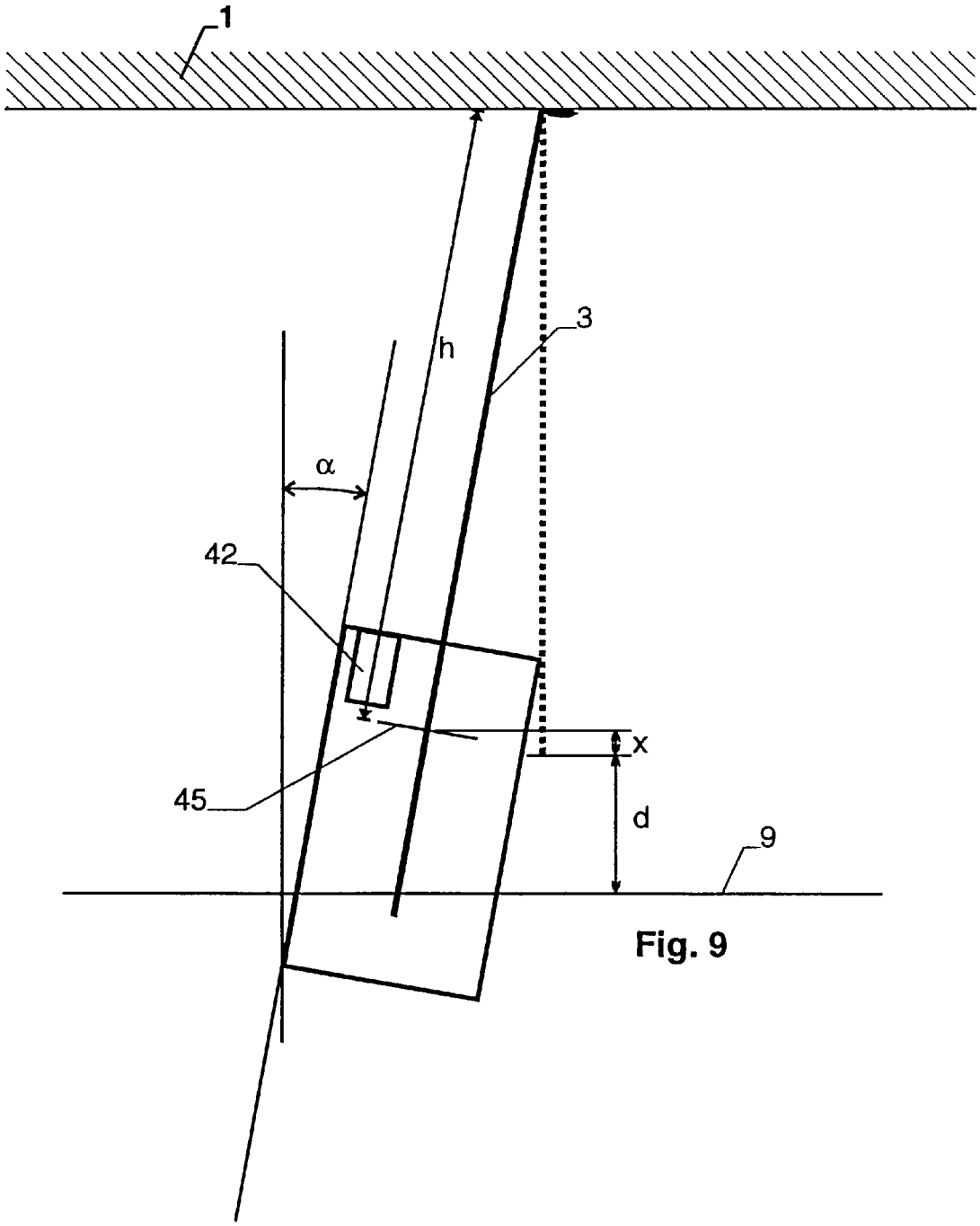
FIG. 9 is an illustration of the angle correction.

If the device is operated by hand, however, an exact vertical alignment is not guaranteed and it is possible that mounting member 3 is inclined by an angle U in respect to the vertical direction, as it is shown in FIG. 9. For handling such situations, the device is equipped with the inclination detector 41 for measuring angle α. At the same time, distance detector 42 serves for determining the distance h of the cutting position 45 from concrete ceiling 1. The knowledge of angle α and distance h, together with stored information on the geometry of the device and the position of detector 34 on the housing allow to calculate a correcting value x to be added to distance d before cutting mounting member 3.

The embodiment shown here can also be used, with minor modifications, for cutting threaded rods if they are used as mounting members instead of suspension wires. In principle, any type of rod-shaped mounting members can be cut off in the same way.

Instead of cutting the mounting members, they can also be worked in other suitable ways for generating a reference point thereon. For instance, the mounting member can be pinched in order to generate a stop at the appropriate height for adjusting the suspension members. A device according to the invention can also be designed for automatically mounting the suspension members, in which case a cutting, pinching or other mechanical working may be dispensed with.

The device can be used wherever an object must be leveled on rod-like mounting members, such as when mounting wall facades, floors or larger machinery.

Depending on application, further parameters can be entered via keyboard 36. If, for instance, a suspended inclined ceiling is to be leveled, the desired angle of the ceiling in respect to the horizontal direction can be entered.

Details of the device are to be adapted to the specific requirements of an application. For instance, another means for generating the reference mark can be used instead of holder 23 and cutter 24, e. g. a device for screwing a nut onto a threading of the mounting member.

It is also possible that the reference generating means merely generates a mark on mounting means 3, which then can be used for visual control of the position of a clip.

The set-up of the device shown in FIG. 8 can be varied in several aspects. For example, detector 34 and/or keyboard 36 can be mounted to holder rod 38. Also, several detectors 34 can be provided for allowing a measurement for any position of laser leveling device 8. Preferably, the detector (or detectors) is (are) arranged as close to the axis of mounting member 3 as possible such that only a small angle error is induced when the device is held under an inclined position.

Holder rod 38 can also be affixed axially to housing 15 and e.g. form a canal for the removal of cut off sections of mounting members 3.

Preferably, the device is equipped with a sound generator for generating a signal indicating successful cutting or marking of the mounting member.

Depending on application, it is also possible to provide a drive for automatically pulling the mounting member into the device such that it is not necessary to displace it by hand.

Size and weight of the device are such that it can be operated easily by hand.

In the embodiment shown in the figures, the reference level is defined by a laser. It is, however, also possible that another method is used for this purpose, such as triangulation or mechanical means, wherein the detector 34 is to be adapted accordingly.

While there are shown and described presently preferred embodiments of the invention, it is to be distinctly understood that the invention is not limited thereto but may be otherwise variously embodied and practiced w thin the scope of the following claims.

What is claimed is:

1. A device for leveling an object, in particular a suspended ceiling, which object is mounted to a plurality of rod-like mounting members, said device comprising:

a reference level detector for detecting a reference level, a guiding means for longitudinally guiding one of said mounting members, and a cutter for cutting each of said rod-like mounting members and forming an end of each of said rod-like mounting members at a predefined distance from said reference level.

2. The device of claim 1 further comprising a holder means for hosing said one mounting member while said one mounting member is being cut by said cutter.

3. The device of claim 2 further comprising adjustment means for adjusting a position of said reference generating means in respect to said holder means.

4. The device of claim 1, wherein said guiding means comprises a funnel-shaped opening for introducing said one mounting member.

5. The device of claim 1, wherein said reference level detector comprises a detector holder for mounting said reference level detector in at least two different positions on said device.

6. The device of claim 1 further comprising a control with input means for entering a desired distance between said end and said reference level.

7. The device of claim 1 further comprising a housing and a holder rod mounted to said housing.

8. The device of claim 1 wherein said reference level detector is designed for detecting a level generated by a laser.

9.A device for leveling an object, in particular a suspended ceiling, which object is mounted to a plurality of rod-like mounting members, said device comprising:

a reference level detector for detecting a reference level, a guiding means for longitudinally guiding one of said mounting members, and a cutter for cutting each of said rod-like mounting members and forming an end of each of said rod-like mounting members at a predefined distance from said reference level, further comprising an angle detector for detecting an angle between said one mounting member and said reference level.

10. The device of claim 9, further comprising a distance detector for detecting the distance of said device a wall or ceiling.

11. A device for leveling an object, in particular a suspended ceiling, which object is mounted to a plurality of rod-like mounting members, said device comprising:

a reference level detector for detecting a reference level, a guiding means for longitudinally guiding one of said mounting members, a reference generating means controlled by said reference level detector for automatically generating a reference point on said one mounting member, an angle detector for detecting an angle between said one mounting member and said reference level, and wherein said angle detector is designed for measuring an angle of said one mounting member in respect to a vertical direction.

12. A method for suspending a ceiling from rod-like mounting members comprising the steps of:

providing a reference level, cutting off said mounting members to form ends at a predefined distance from said reference level, attaching individual suspension members to each of said ends of said mounting members, using said ends as stops for positioning said suspension members, and suspending said ceiling on said suspension members.

13. The method of claim 12 further comprising the steps of using a laser for providing said reference level and applying a cutter device to each of said mounting members, which cutter device detects said reference level and cuts off said mounting members at said predefined distance.

14. A method for suspending a ceiling from rod-like mounting members comprising the steps of:

providing a reference level, cutting off said mounting members to form ends at a predefined distance from said reference level, attaching individual suspension members to each of said ends of said mounting members, using said ends as stops for positioning said suspension members, and suspending said ceiling on said suspension members further comprising the steps of:

measuring an angle between each mounting member and said reference level, and using said angle for correcting said predefined distance.

* * * * *